US007397458B2

(12) United States Patent
Maki

(10) Patent No.: US 7,397,458 B2
(45) Date of Patent: Jul. 8, 2008

(54) DISPLAY GRAYSCALE CONTROL USING OPERATIONAL AMPLIFIERS

(75) Inventor: Katsuhiko Maki, Chino (JP)

(73) Assignee: Seiko Epson Corporation, Tokyo (JP)

( * ) Notice: Subject to any disclaimer, the term of this patent is extended or adjusted under 35 U.S.C. 154(b) by 632 days.

(21) Appl. No.: 10/883,795

(22) Filed: Jul. 6, 2004

(65) Prior Publication Data

US 2005/0007394 A1 Jan. 13, 2005

(30) Foreign Application Priority Data

Jul. 8, 2003 (JP) ..... 2003-193672
May 11, 2004 (JP) ..... 2004-141118

(51) Int. Cl.
*G09G 3/36* (2006.01)

(52) U.S. Cl. ..... 345/89; 345/690

(58) Field of Classification Search ..... 345/100, 345/690, 204–205, 211–214, 55, 87–90, 345/93, 98–99
See application file for complete search history.

(56) References Cited

U.S. PATENT DOCUMENTS 5,552,800 A * 9/1996 Uchikoga et al. ..... 345/89
5,555,000 A * 9/1996 Sarrasin et al. ..... 345/75.2
6,535,189 B1 * 3/2003 Akiyama et al. ..... 345/87
6,580,410 B1 * 6/2003 Nishimura et al. ..... 345/89
7,046,224 B2 * 5/2006 Monomohshi ..... 345/89
7,136,039 B2 * 11/2006 Bu et al. ..... 345/98
7,151,549 B2 * 12/2006 Kudo et al. ..... 345/690

FOREIGN PATENT DOCUMENTS

CN 1450518 A 10/2003
JP A-11-231845 8/1999
JP A-2003-140618 5/2003
JP A-2003-302949 10/2003

* cited by examiner

*Primary Examiner*—Alexander Eisen
*Assistant Examiner*—Jason M Mandeville
(74) *Attorney, Agent, or Firm*—Oliff & Berridge, PLC

(57) ABSTRACT

A problem arises with related art liquid crystal displays in that the amount of power consumed will not be reduced any further, as a voltage generator circuit to supply power is kept activated. An exemplary method for driving a display uses a first plurality of operational amplifiers to generate a first plurality of voltages of different levels associated with a first plurality of grayscale levels displayable in the display so as to provide the display with a second plurality of grayscale levels out of the first plurality of grayscale levels. The method includes activating a second plurality of operational amplifiers corresponding to the second plurality of grayscale levels out of the first plurality of operational amplifiers, and deactivating remaining operational amplifiers other than the second plurality of operational amplifiers.

8 Claims, 6 Drawing Sheets

73A

| OP No. | Image data D5 - D0 | Grayscale data | | | | | |
|---|---|---|---|---|---|---|---|
| | | GS=2 | GS=4 | GS=8 | GS=16 | GS=32 | GS=64 |
| 0 | 000000 | ○ | ○ | ○ | ○ | | |
| 1 | 000001 | | | | | | |
| 2 | 000010 | | | | | | |
| 3 | 000011 | | | | | | |
| 4 | 000100 | | | | ○ | | |
| 5 | 000101 | | | | | | |
| 6 | 000110 | | | | | | |
| 7 | 000111 | | | | | | |
| 8 | 001000 | | | | ○ | | |
| 9 | 001001 | | | ○ | | | |
| 10 | 001010 | | | | | | |
| 11 | 001011 | | | | | | |
| 12 | 001100 | | | | ○ | | |
| 13 | 001101 | | | | | | |
| 14 | 001110 | | | | | | |
| 15 | 001111 | | | | | | |
| 16 | 010000 | | | | ○ | | |
| 17 | 010001 | | | | | | |
| 18 | 010010 | | | ○ | | | |
| 19 | 010011 | | | | | | |
| 20 | 010100 | | | | ○ | | |
| 21 | 010101 | | ○ | | | | |
| 22 | 010110 | | | | | | |
| 23 | 010111 | | | | | | |
| 24 | 011000 | | | | ○ | | |
| 25 | 011001 | | | | | | |
| 26 | 011010 | | | | | | |
| 27 | 011011 | | | ○ | | | |
| 28 | 011100 | | | | ○ | | |
| 29 | 011101 | | | | | | |
| 30 | 011110 | | | | | | |
| 31 | 011111 | | | | | | |
| 32 | 100000 | | | | | | |
| 33 | 100001 | | | | | | |
| 34 | 100010 | | | | ○ | | |
| 35 | 100011 | | | | | | |
| 36 | 100100 | | | ○ | | | |
| 37 | 100101 | | | | | | |
| 61 | 111101 | | | | | | |
| 62 | 111110 | | | | | | |
| 63 | 111111 | ○ | ○ | ○ | ○ | | |

FIG. 4

DISPLAY GRAYSCALE CONTROL USING OPERATIONAL AMPLIFIERS

BACKGROUND OF THE INVENTION

1. Field of Invention

The present invention relates to a display driving method and a driver to drive a display, such as a liquid crystal display (LCD) panel. More particularly, the invention relates to a display driving method and a driver to apply multiple voltages associated with multiple grayscale levels specified by a plurality of image data to a plurality of source lines (data lines) of a number of thin film transistors (TFTs) provided in such an LCD panel.

2. Description of Related Art

To generate multiple potentials, for example, 64 potentials associated with 64 grayscale levels, related art display drivers require 64 operational amplifiers. Assuming that each of the 64 operational amplifiers consumes a current of 100 μA, all of the 64 operational amplifiers consume 6.4 mA (100 μA×64) in total. When using a power voltage of 5 V, for example, this results in a large amount of power consumed, which reaches 32 mW (6.4 mA×5 V).

The LCD disclosed in Japanese Unexamined Patent Publication No. 2003-140618 (p. 1, FIG. 1), which is an example of such a display, is capable of reducing the total amount of power consumed for the LCD by switching the supply of operational power to a voltage generator circuit, corresponding to the operational amplifiers, between multi-grayscale display and dual-grayscale display.

SUMMARY OF THE INVENTION

The related art LCD, however, does not switch the supply of power when providing only the multi-grayscale display. Since the voltage generator circuit is kept activated in this state of things, a problem arises in that the amount of power consumed will not be reduced any further.

In order to address the above and/or other problems, a first exemplary method to drive a display according the present invention uses a first plurality of operational amplifiers to generate a first plurality of voltages of different levels associated with a first plurality of grayscale levels displayable in the display so as to provide the display with a second plurality of grayscale levels out of the first plurality of grayscale levels. The method includes activating a second plurality of operational amplifiers corresponding to the second plurality of grayscale levels out of the first plurality of operational amplifiers and deactivating remaining operational amplifiers other than the second plurality of operational amplifiers.

With the first exemplary method to drive a display according to the present invention, which activates the second plurality of operational amplifiers out of the first plurality of operational amplifiers and deactivates the remaining operational amplifiers, it is possible to reduce power consumed compared to related art display drivers that always activate the first plurality of operational amplifiers.

A second exemplary method to drive a display according to the present invention uses a first plurality of operational amplifiers to generate a first plurality of voltages of different levels associated with a first plurality of grayscale levels displayable in the display so as to perform displaying of the display. The method includes, prior to a horizontal synchronization period, identifying a second plurality of operational amplifiers corresponding to a second plurality of grayscale levels to be displayed on the display during the horizontal synchronization period out of the first plurality of operational amplifiers; and activating the second plurality of operational amplifiers and deactivating remaining operational amplifiers other than the second plurality of operational amplifiers.

With the second exemplary method to drive a display according to the present invention, which identifies the second plurality of operational amplifiers out of the first plurality of operational amplifiers prior to the horizontal synchronization period, and activates the second plurality of operational amplifiers and deactivates the remaining operational amplifiers, it is possible to make the remaining operational amplifiers remain deactivated during the horizontal synchronization period and thus reduce power consumed compared to related art display drivers that always activate the first plurality of operational amplifiers, that is, both the second plurality of operational amplifiers and the remaining operational amplifiers, during the horizontal synchronization period.

In the second exemplary method to drive a display according to the present invention, it is preferable that the display includes a plurality of source lines; each of the second plurality of grayscale levels being specified by one of a plurality of image data corresponding to the plurality of source lines, each of the plurality of image data specifying one of the first plurality of grayscale levels; the identifying including referring to all of the plurality of image data at once so as to identify the second plurality of operational amplifiers corresponding to the second plurality of grayscale levels specified by the plurality of image data out of the first plurality of operational amplifiers.

In the second exemplary method to drive a display according to the present invention, it is preferable that the display includes a plurality of source lines; each of the second plurality of grayscale levels being specified by one of a plurality of image data corresponding to the plurality of source lines, each of the plurality of image data specifying one of the first plurality of grayscale levels; the identifying including referring the plurality of image data sequentially so as to identify the second plurality of operational amplifiers corresponding to the second plurality of grayscale levels specified by the plurality of image data out of the first plurality of operational amplifiers.

In the second exemplary method to drive a display according to the present invention, it is preferable that the display includes a plurality of source lines; each of the second plurality of grayscale levels being specified by one of a plurality of image data corresponding to the plurality of source lines, each of the plurality of image data specifying one of the first plurality of grayscale levels; the identifying including examining a plurality of blocks, block by block, each of the plurality of blocks including two or more image data divided from the plurality of image data, so as to identify the second plurality of grayscale levels out of the first plurality of grayscale levels, and a degree of activating the second plurality of operational amplifiers is calculated based on a number of the two or more image data; the activation and deactivation including activating the second plurality of operational amplifiers according to the degree of activation calculated in the identification step.

Driver

A first exemplary driver to drive a display according to the present invention includes a plurality of vertical lines connectable to the display that is driven by using a first plurality of voltages of different levels associated with a first plurality of grayscale levels displayable in the display, a first plurality of horizontal lines connectable to the plurality of vertical lines, a plurality of switches to establish and terminate a connection between the plurality of vertical lines and the first plurality of horizontal lines, a first plurality of operational amplifiers including an output terminal coupled to one of the first plurality of horizontal lines to generate the first plurality of voltages, a control circuit for making the plurality of switches establish and terminate a connection between the plurality of vertical lines and the first plurality of horizontal lines according to a second plurality of grayscale levels to be displayed on the display out of the plurality of grayscale levels, a charging circuit to charge a second plurality of horizontal lines coupled to at least one of the plurality of vertical lines out of the first plurality of horizontal lines with the plurality of switches by charging the plurality of vertical lines, a detection circuit to detect the second plurality of horizontal lines that are charged, and an activation circuit to activate a second plurality of operational amplifiers coupled to the second plurality of horizontal lines detected by the detection circuit.

In the first exemplary driver to drive a display according to the present invention, the control circuit makes the plurality of switches establish and terminate a connection between the plurality of vertical lines and the first plurality of horizontal lines based on the second plurality of grayscale levels, the detection circuit detects the second plurality of horizontal lines that are coupled to the plurality of vertical lines by turning on and shutting off of the plurality of switches and charged by the charging circuit out of the first plurality of horizontal lines, and the activation circuit activates only the second plurality of operational amplifiers that are coupled to the second plurality of horizontal lines that are charged out of the first plurality of operational amplifiers. Therefore, it is possible to reduce power consumed compared to related art display drivers that always activate the first plurality of operational amplifiers.

The first exemplary driver to drive a display according to the present invention preferably includes a discharging circuit to discharge the plurality of vertical lines and the first plurality of horizontal lines, prior to the charging of the plurality of vertical lines by the charging circuit.

Decoder circuit

A second exemplary driver to drive a display according to the present invention includes a first plurality of operational amplifiers to generate a first plurality of voltages of different levels associated with a first plurality of grayscale levels displayable in the display, and a decoder circuit for, by referring to a conversion table specifying correspondence between two or more grayscale levels out of the first plurality of grayscale levels and a plurality of representative grayscale levels that represent the two or more grayscale levels, the plurality of representative grayscale levels being fewer than the first plurality of grayscale levels, converting each of a second plurality of grayscale levels to be displayed on the display out of the first plurality of grayscale levels into one of the plurality of representative grayscale levels and activating an operational amplifier corresponding to the one of the plurality of representative grayscale levels out of the first plurality of operational amplifiers.

In the second exemplary driver to drive a display according to the present invention, by referring to the conversion table, the decoder circuit converts each of the second plurality of grayscale levels into the one representative grayscale level and activates an operational amplifier corresponding to the representative grayscale level out of the first plurality of operational amplifiers. Here, the power consumed by an operational amplifier is the total of stationary power that is fixedly consumed irrespective of the size of the load or grayscale level of the operational amplifier (the number of grayscale levels assigned to the operational amplifier to generate a voltage) and load power that is consumed depending on the size of the load of the operational amplifier as widely known. For example, if eight grayscale levels to be displayed on the display are represented by two representative grayscale levels and two operational amplifiers corresponding to the two representative grayscale levels are activated, the total power consumed (a total of two stationary powers and eight load powers) is less than the amount of power consumed by eight operational amplifiers generating eight voltage levels for the eight grayscale levels (resulting in a total of eight stationary powers and eight load powers) by six stationary powers. Therefore, with the second exemplary driver to drive a display according to the present invention, it is possible to reduce the power consumed compared to related art drivers that activate a plurality of operational amplifiers (eight in the above example) corresponding to the second plurality of grayscale levels that are more than the operational amplifiers (two in the above example) corresponding to the representative grayscale levels.

BRIEF DESCRIPTION OF THE DRAWINGS

FIG. 4 is a schematic that shows a conversion table of the exemplary embodiment;

DETAILED DESCRIPTION OF PREFERRED EMBODIMENTS

An exemplary embodiment of a display driver of the present invention is described below with reference to the accompanying drawings.

Figure 1:
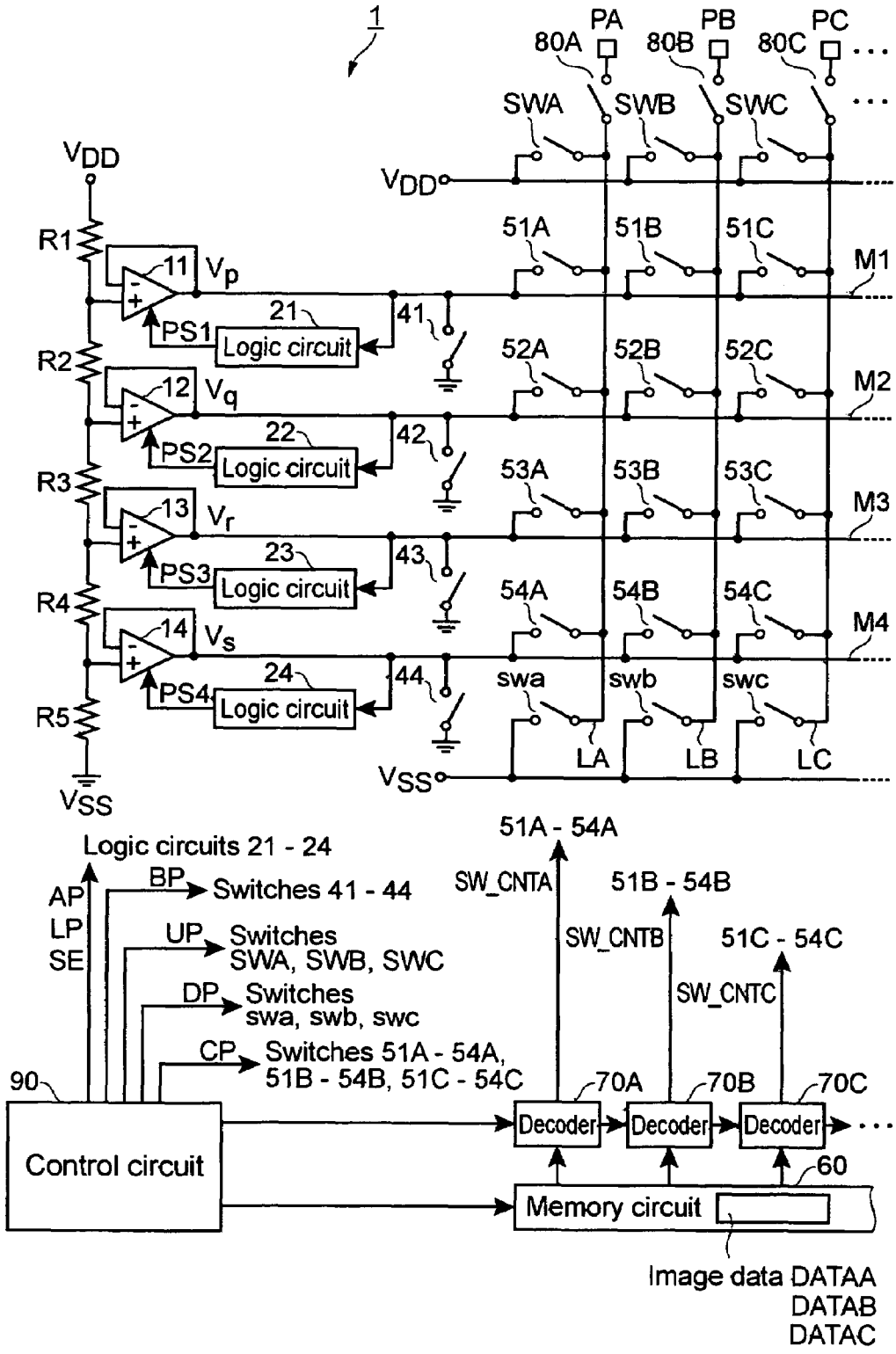
FIG. 1 is a schematic that shows a display driver according to one exemplary embodiment of the present invention.

FIG. 1 shows a display driver according to one exemplary embodiment of the invention. A driver 1 of the present exemplary embodiment provides a display with four grayscale levels according to line-by-line sequential drives. In order to address or achieve this, the driver 1 has a function of applying voltages associated with grayscale levels specified by image data to contact points PA, PB, PC (the three shown by way of example, and not as a limitation) by horizontal lines M1, M2, M3, M4 and vertical lines LA, LB, LC. Each of the contact points is coupled to a source line of a plurality of TFTs included in a display, such as an LCD panel.

To perform this function, the driver 1 includes operational amplifiers 11, 12, 13, 14; logic circuits 21, 22, 23, 24; switches 41, 42, 43, 44; switches 51A, 52A, 53A, 54A, 51B, 52B, 53B, 54B, 51C, 52C, 53C, 54C; a memory circuit 60; decoders 70A, 70B, 70C; switches 80A, 80B, 80C; a control circuit 90; resistors R1, R2, R3, R4, R5; switches SWA, SWB, SWC; and switches swa, swb, sbc as shown in FIG. 1.

The operational amplifiers 11 to 14 output four voltages Vp, Vq, Vr, Vs to the horizontal lines M1 to M4. The four voltages are associated with the four grayscale levels specified by divided voltages using the resistors R1 to R5 based on a power potential VDD (3 V or 5V, for example) and a ground potential VSS. The voltages Vp, Vq, Vr, Vs output by the operational amplifiers 11, 12, 13, 14, respectively, satisfy the inequality Vp>Vq>Vr>Vs. Here, the operational amplifier is referred to as general amplifiers including related art operational amplifiers.

Provided in between the horizontal lines M1 to M4 and the operational amplifiers 11 to 14, the logic circuits 21 to 24 activate or deactivate the operational amplifiers 11 to 14 under the control of the control circuit 90.

The switches 41 to 44 are provided in between the horizontal lines M1 to M4 and the ground potential VSS. For example, the switch 41 is provided in between the horizontal line M1 and the ground potential VSS.

The switches 51A to 54A, 51B to 54B, 51C to 54C are provided in matrix form in between the vertical lines LA, LB, LC and the horizontal lines M1, M2, M3, M4. For example, the switch 51A is provided in between the vertical line LA and the horizontal line M1.

The memory circuit 60 stores a plurality of image data DATAA, DATAB, DATAC that specify an image to be displayed on the display.

The decoders 70A, 70B, 70C output switching control signals SW_CNTA, SW_CNTB, SW_CNTC associated with the plurality of image data DATAA, DATAB, DATAC stored in the memory circuit 60 to the switches 51A to 54C under the control of the control circuit 90.

According to the present exemplary embodiment, the decoders 70A, 70B, 70C and the control circuit 90 cooperate to output (1) activation control signals AP, LP, SE to control activation and deactivation by the logic circuits 21 to 24 to the logic circuits 21 to 24; (2) an open/close control signal BP to control the open/close of the switches 41 to 44 to the switches 41 to 44; (3) an open/close control signal UP to control the open/close of the switches SWA, SWB, SWC to the switches SWA, SWB, SWC; (4) an open/close control signal DP to control the open/close of the switches swa, swb, swc to the switches swa, swb, swc; and (5) an open/close control signal CP to control the open/close of the switches 51A to 54A, 51B to 54B, 51C to 54C to the switches 51A to 54A, 51B to 54B, 51C to 54C.

The switches 80A, 80B, 80C are provided in between the contact points PA, PB, PC, which are included in the display, and the vertical lines LA, LB, LC. For example, the switch 80A is provided in between the contact point PA and the vertical line LA.

The control circuit 90 outputs the above-mentioned control signals AP, LP, SE, BP, CP, UP, DP, so as to control the whole operation of the driver 1.

The switches SWA, SWB, SWC are provided in between the vertical lines LA, LB, LC and the power potential VDD. For example, the switch SWA is provided in between the vertical line LA and the power potential VDD.

The switches swa, swb, swc are provided in between the vertical lines LA, LB, LC and the ground potential VSS. For example, the switch swa is provided in between the vertical line LA and the ground potential VSS.

Figure 2:
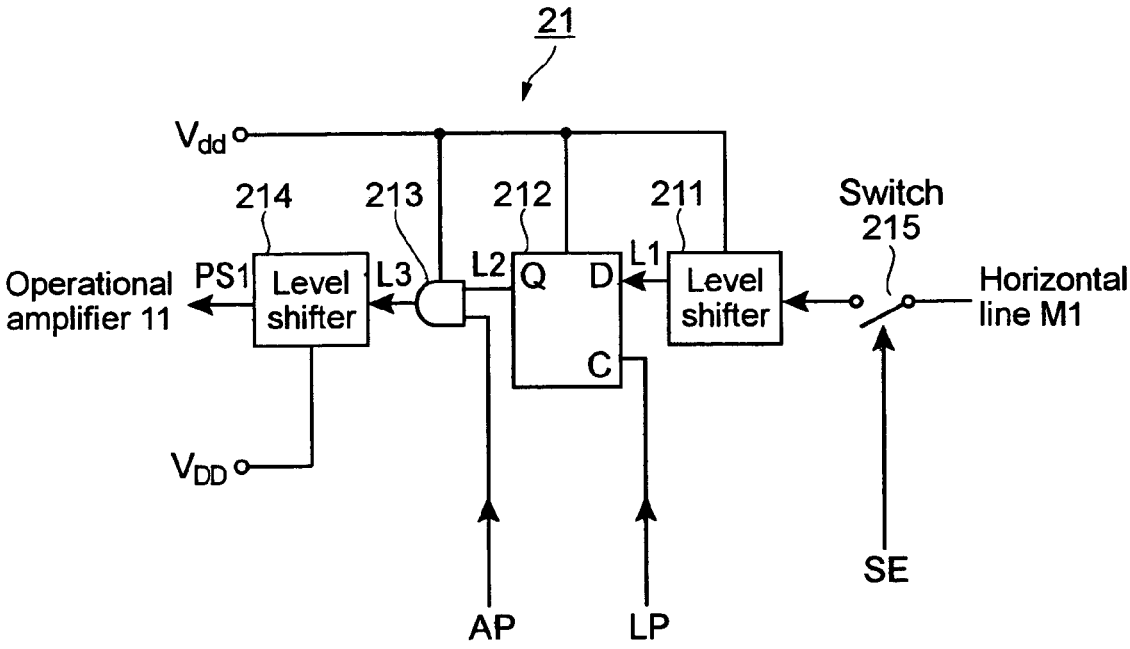
FIG. 2 is a schematic that shows a logic circuit of the exemplary embodiment.

FIG. 2 shows the configuration of the logic circuit according to the present exemplary embodiment of the invention. The logic circuit 21 operates at both the power voltage VDD and an operational voltage Vdd (1.5 V, for example) that is lower than the operational voltage VDD of the logic circuit 21, i.e. the power voltage VDD. The logic circuit 21 detects the power voltage VDD applied to the horizontal line M1 from the power potential VDD via the switch SWA, at least one of the vertical lines LA, LB, LC, and at least one of the switches 51A, 51B, 51C. To perform this, the logic circuit 21 includes a level shifter 211, a flip-flop 212, an AND circuit 213, a level shifter 214, and a switch 215 as shown in FIG. 2. The level shifter 211, the flip-flop 212, and the AND circuit 213 operate at the voltage Vdd, while the level shifter 214 operates at the voltage VDD.

The switch 215 establishes or terminates a connection between the horizontal line M1 and the level shifter 211 according to the activation control signal SE from the control circuit 90.

The level shifter 211 lowers the voltage level of the power voltage VDD applied to the horizontal line M1. The flip-flop 212 latches a signal L1 from the level shifter 211 in sync with the activation control signal LP from the control circuit 90. The AND circuit 213 performs the logical AND operation between a signal L2 from the flip-flop 212 and the activation control signal AP from the control circuit 90 to output a signal L3. This means that the AND circuit 213 outputs the signal L3 at a timing specified by the activation control signal AP. The level shifter 214 raises the voltage level of the signal L3. Thus the logic circuit 21 outputs a power control signal PS1 to activate or deactivate the operational amplifier 11. The other logic circuits 22 to 24 also have the same configuration and operate in the same manner as the logic circuit 21, outputting power control signals PS2 to PS4 to the operational amplifiers 12 to 14, respectively.

Instead of the above-mentioned configuration of the logic circuits 21 to 24, the logic circuits 21 to 24 are also capable of outputting the control signals PS1 to PS4 with the configuration composed of the switch 215, the flip-flop 212, and the AND circuit 213 when the power voltage VDD and the operational voltage VDD of the logic circuits 21 to 24 are exactly or nearly the same (for example, both of the voltages VDD and Vdd are around 5 V).

Figure 3:
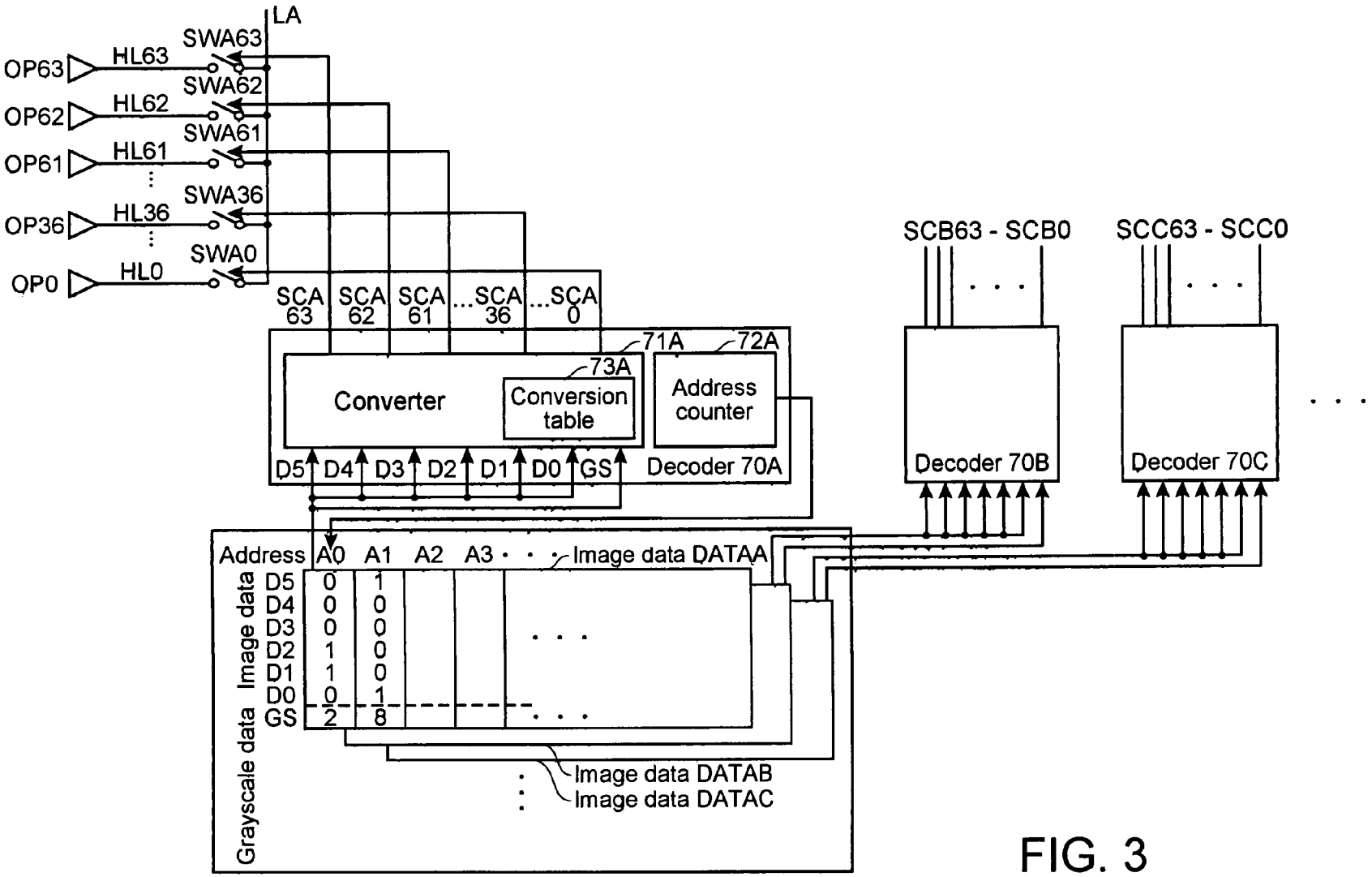
FIG. 3 is a schematic that shows a memory circuit and decoders of the exemplary embodiment.

FIG. 3 shows the configuration of the memory circuit and the decoders according to the present exemplary embodiment of the invention. To facilitate the description referring to FIG. 3 and understanding of the memory circuit and the decoders according to the present exemplary embodiment, here the four grayscale levels are replaced by 64 grayscale levels (six bits), the four operational amplifiers 11 to 14 by 64 operational amplifiers OP0 to OP63, and the four switches 51A to 54A by 64 switches SWA0 to SWA63.

As shown in FIG. 3, the memory circuit 60 stores the image data DATAA, DATAB, DATAC. For example, the image data DATAA are composed of image data D5 to D0 (six bits) to specify a grayscale level out of the 64 levels and grayscale data GS selected from 2, 4, 8, 16, 32, or 64. Both the image data D5 to D0 and the grayscale data GS are given an address. For example, the image data D5 to D0 of 000110 and the grayscale data GS of 2 are stored in an address A0 included in the image data DATAA. The other image data DATAB, DATAC also have the same configuration as the image data DATAA.

As shown in FIG. 3, the decoder 70A outputs switching control signals SCA0 to SCA63 to control turning on and shutting off of the switches SWA0 to SWA63 to the switches SWA0 to SWA63 based on the image data D5 to D0 and the grayscale data GS included in the image data DATAA stored in the memory circuit 60. To achieve this, the decoder 70A includes a converter 71A to convert the image data D5 to D0 and the grayscale data GS into the switching control signals SCA0 to SCA63, and an address counter 72A to count the number of addresses included in the image data DATAA, as shown in FIG. 3. The converter 71A further includes a conversion table 73A defining the correspondence among the image data D5 to D0, the grayscale data GS, and the operational amplifiers OP0 to OP63.

FIG. 4 shows the configuration of the conversion table according to the present exemplary embodiment of the invention. The conversion table 73A includes the numbers of the operational amplifiers OP, the values of the image data D5 to D0, and the values of the grayscale data GS as shown in FIG. 4. The conversion table 73A shows that, for example, the image data D5 to D0 ranging from 000100 to 000111 with the grayscale data GS of 16 are represented by the marked image data of 000100 corresponding to the operational amplifier OP4. In other words, the four grayscale levels ranging from 000100 to 000111 are represented by one marked representative grayscale level 000100 corresponding to the operational amplifier OP4.

Referring back to FIG. 3, the address counter 72A specifies the address A0 in the image data DATAA stored in the memory circuit 60, making the converter 71A read out the image data D5 to D0 and the grayscale data GS corresponding to the address A0 (the image data D5 to D0 and the grayscale data GS corresponding to the address A0 in the image data DATAA are hereinafter referred to as image data D5 to D0 (A_A0) and grayscale data GS (A_A0), and the same goes for the other image data DATAB, DATAC.). With the image data D5 to D0 (A_A0) of 000110 and the grayscale data GS (A_A0) of 2, the converter 71A refers to the column GS=2 of the conversion table 73A, and specifies the operational amplifier OP0 that corresponds to the marked representative grayscale level 000000. The converter 71A outputs the switching control signals SCA0 to SCA63 (corresponding to SW_CNTA in FIG. 1) for making the switch SWA0 for the operational amplifier OP0 turn on and the other switches SWA1 to SWA63 shut off to the switches SWA0 to SWA63, and thereby connecting the vertical line LA (corresponding to the vertical line LA in FIG. 1) and a horizontal line HL0 (corresponding to any of the horizontal lines M1 to M4 in FIG. 1), that is, making a connection between the vertical line LA and the operational amplifier OP0.

In sync with the output of the switching control signals SCA0 to SCA63 based on the image data D5 to D0 (A_A0) and the grayscale data GS (A_A0) from the decoder 70A, the other decoders 70B, 70C also output switching control signals SCB0 to SCB63, SCC0 to SCC63 based on image data D5 to D0 (B_A0), (C_A0) and grayscale data GS (B_A0), (C_A0) to switches SWBO to SWB63, SWCO to SWC63 (the switches not shown, corresponding to the switches 51B to 54B, 51C to 54C in FIG. 1), respectively, provided in between the horizontal lines HL0 to HL63 and the vertical lines LB, LC in the same manner.

For example, the switch SWB0 is made turn on by the switching control signals SCB0 to SCB63 based on the image data D5 to D0 (B_A0) of 001100 and the grayscale data GS (B_A0) of 2, while the switch SWC0 is made turn on by the switching control signals SCC0 to SCC63 based on the image data D5 to D0 (C_A0) of 011011 and the grayscale data GS (C_A0) of 2. Also, since the grayscale data GS (A_A0), (B_A0), (C_A0) are all 2, the operational amplifiers OP1 to OP62 other than the operational amplifiers OP0 and OP63 remain deactivated. At the same time, only the operational amplifier OP0 is activated according to the image data D5 to D0 (A_A0), (B_A0), (C_A0), while the operational amplifier OP63 remains deactivated.

The address counter 72A specifies an address A1 in the image data DATAA stored in the memory circuit 60 following the address A0, making the converter 71A read out image data D5 to D0 (A_A1) and grayscale data GS (A_A1) corresponding to the address A1 from the memory circuit 60. With the image data D5 to D0 (A_A1) of 100001 and the grayscale data GS (A_A1) of 8, the converter 71A refers to the conversion table 73A and specifies the operational amplifier OP36 that corresponds to the marked representative grayscale level 100100. The converter 71A outputs the switching signals SCA0 to SCA63 to make the switch SWA36 turn on and the other switches SWA0 to SWA35 and SWA37 to SWA63 shut off to the switches SWA0 to SWA63, and thereby connecting the vertical line LA and the horizontal line HL36, that is, making a connection between the vertical line LA and the operational amplifier OP36.

In the same manner as mentioned above, in sync with the output of the switching control signals SCA0 to SCA63 based on the image data D5 to D0 (A_A1) and the grayscale data GS (A_A1) from the decoder 70A, the other decoders 70B, 70C also output the switching control signals SCB0 to SCB63, SCC0 to SCC63 based on image data D5 to D0 (B_A1), (C_A1) and grayscale data GS (B_A1), (C_A1) to the switches SWB0 to SWB63, SWC0 to SWC63, respectively.

According to the present exemplary embodiment, for example, when the grayscale data GS (A_A0), GS (B_A0), and GS (C_A0) are all 4, the image data D5 to D0 (A_A0) is 000000, D5 to D0 (B_A0) is 000001, and D5 to D0 (C_A0) is 000010, the decoders 70A, 70B, 70C do not activate all the three operational amplifiers OP0, OP1, OP2 corresponding to the grayscale levels of 000000, 000001, 000010, respectively, but activate only the operational amplifier OP0 corresponding to the grayscale level of 000000 that represents the three grayscale levels. Here, the power consumed by an operational amplifier is the total of stationary power (power consumed irrespective of the size of the load or grayscale level of the operational amplifier) and load power (power consumed depending on the size of the load of the operational amplifier) as widely known. If one operational amplifier takes three grayscale levels, the amount of power it consumes (a total of one stationary power and three load powers) is less than the amount of power consumed by three operational amplifiers each taking a grayscale level (resulting in a total of three stationary powers and three load powers) as with the case of related art methods. Therefore, making the decoders 70A, 70B, 70C activate one operational amplifier OP0 can reduce the power consumed compared to the related art methods in which the three operational amplifiers OP0, OP1, OP2 are all activated.

Figure 5:
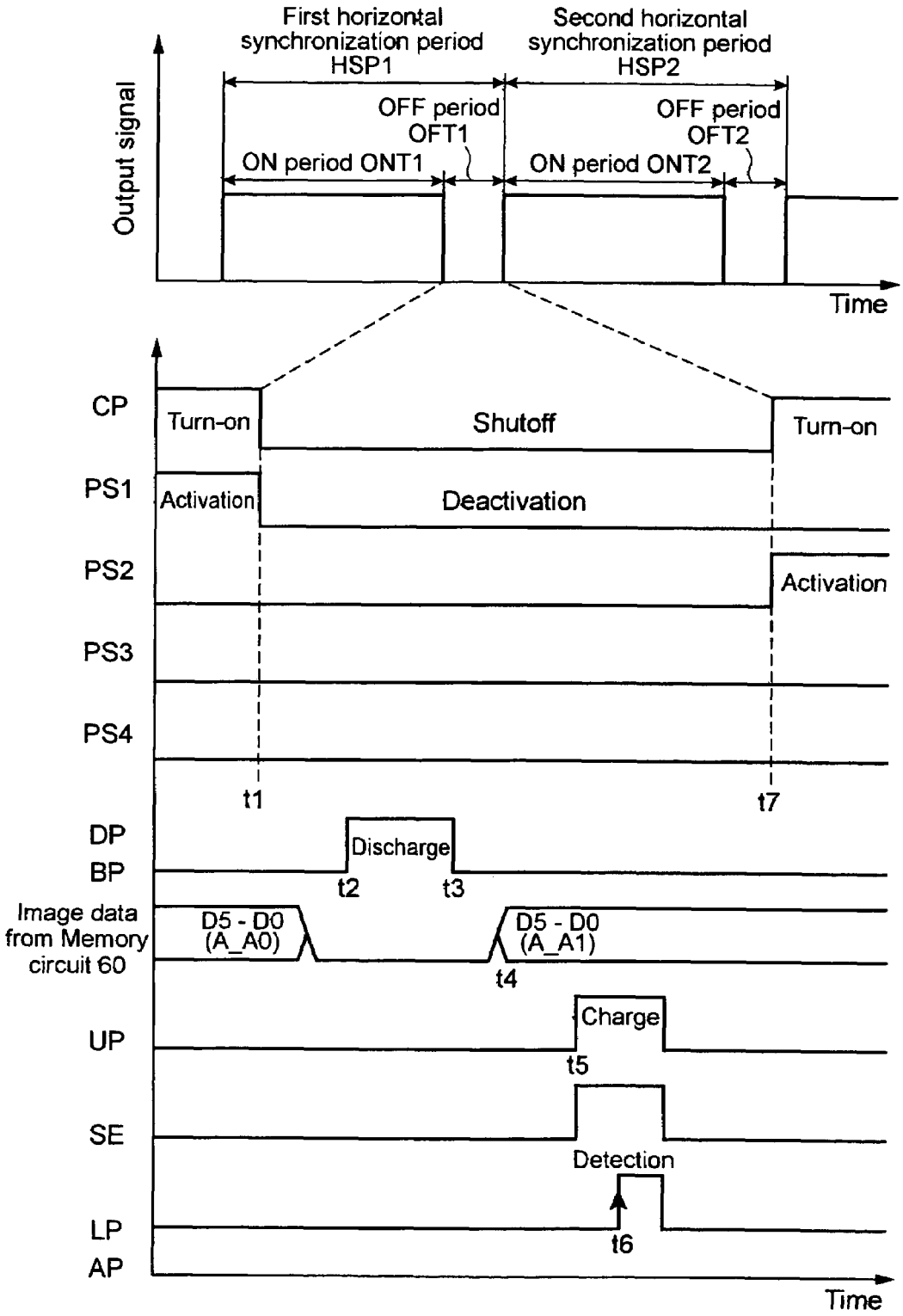
FIG. 5 is a schematic that shows the operation of the driver of the exemplary embodiment.

FIG. 5 shows the operation of the driver according to the present exemplary embodiment of the invention. The driver 1 drives a plurality of gate lines (not shown in the drawing) of a display line by line as shown in FIG. 5. In other words, a gate line is driven during a horizontal synchronization period (1H) in which a voltage based on a grayscale level specified by the image data D5 to D0 (A_A0), (B_A0), (C_A0) etc. via the vertical lines LA, LB, LC corresponding to a plurality of source lines is applied to the plurality of source lines. Since the driving is performed line by line, the decoders 70A, 70B, 70C operate simultaneously, or more specifically, synchronously as described above. For example, the switching control signals SW_CNTA, SW_CNTB, SW_CNTC specified by the image data D5 to D0 (A_A0), (B_A0), (C_A0), respectively, are simultaneously output to the switches 51A to 54A, 51B to 54B, 51C to 54C, respectively. Now the operation of the decoder 70A will be described in greater detail for the better understanding.

During a first horizontal synchronization period HSP1, the decoder 70A activates the operational amplifier 11 corresponding to a grayscale level specified by the image data D5 to D0 (A_A0), for example, the grayscale level of 4 using the power control signal PS1 (at high level) in an ON period ONT1, while deactivates the other operational amplifiers 12, 13, 14 using the power control signals PS2, PS3, PS4 (all at low level). The decoder 70A thus provides the grayscale level of 4 on a display.

Following the display, at a beginning timing t1 of an OFF period OFT1, the control circuit 90 makes the switches 80A, 80B, 80C shut off using the open/close control signal CP (at low level) to control the open/close of the switches 80A, 80B, 80C, while the logic circuits 21 to 24 deactivate the operational amplifiers 11 to 14 using the power control signals PS1 to PS4 (all at low level). Consequently, during the OFF period OFT1 the vertical lines LA, LB, LC and the contact points PA, PB, PC are close, while the operational amplifiers 11 to 14 remain deactivated.

Following the timing t1, at a timing t2 the control circuit 90 makes the switches 41 to 44 turn on using the open/close control signal BP (at high level), that is, making a connection between the horizontal lines M1, M2, M3, M4 and the ground potential VSS. The control circuit 90 also makes the switches swa, swb, swc turn on using the open/close control signal DP (at high level), that is, making a connection between the vertical lines LA, LB, LC and the ground potential VSS. The former connection allows the discharge of any charge possibly remaining on the horizontal lines M1, M2, M3, M4, while the latter connection allows the discharge of any charge possibly remaining on the vertical lines LA, LB, LC. Since only the operational amplifier 11 is activated in the ON period ONT1 as described above, the charge remains only on the horizontal line M1 that is coupled to the operational amplifier 11. The above-mentioned connections discharge the horizontal line M1 and any of the vertical lines LA, LB, LC coupled to the horizontal line M1.

After the discharge begins, at a timing t3 the control circuit 90 outputs the open/close control signal BP (at low level), and thereby making the switches 41 to 44 and the switches swa, swb, swc shut off.

At a timing t4, the decoder 70A reads out the image data D5 to D0 (A_A1) following the image data D5 to D0 (A_A0) from the memory circuit 60, that is, the image data D5 to D0 (A_A1) to specify a grayscale level to be displayed in the next horizontal synchronization period or a second horizontal synchronization period HSP2. Then the decoder 70A outputs the switching control signal SW_CNTA corresponding to the image data D5 to D0 (A_A1) to the switches 51A to 54A, and thereby connecting the vertical line LA and one operational amplifier that is selected from the operational amplifiers 11 to 14 and corresponds to the grayscale level to be achieved based on the image data D5 to D0 (A_A1). The following description assumes that a connection between the vertical line LA and the operational amplifier 12 is made by turning on and shutting off of the switches 51A to 54A according to the switching control signal SW_CNTA based on the grayscale level of 3 specified by the image data D5 to D0 (A_A1).

At a timing t5, the control circuit 90 turns on the switches SWA, SWB, SWC using the open/close control signal UP (at high level), that is, making a connection between the vertical lines LA, LB, LC and the power potential VDD, and thereby setting the vertical lines LA, LB, LC to have the power potential VDD. Since the operational amplifier 12 has a connection to the vertical line LA as mentioned above, the output terminal of the operational amplifier 12, i.e. the horizontal line M2 is set to have the power potential VDD, which means to be charged, via the vertical line LA and the switch 52A.

At this timing t5, the control circuit 90 couples the horizontal lines M1 to M4 to the logic circuits 21 to 24, respectively, all at once using the switching control signal SE (at high level). For example, the control circuit 90 couples the horizontal line M1 to the logic circuit 21 as shown in FIG. 2.

At a timing t6, the control circuit 90 outputs the activation control signals LP, AP to the logic circuits 11 to 14. With the rising edge of the activation control signals LP, AP, the logic circuits 21 to 24 identify whether the power potential VDD is on the horizontal lines M1 to M4, in other words, which of the horizontal lines M1 to M4 is charged.

As mentioned above, only the horizontal line M2 among the horizontal lines M1 to M4 is charged to have the power potential VDD. Therefore, only the logic circuit 22 detects the power potential VDD on the horizontal line M2, and as a result it applies the power control signal PS2 (at high level) to the operational amplifier 12 and recognizes that the operational amplifier 12 is to be activated. Detecting no power potential VDD on the horizontal lines M1, M3, M4, the other logic circuits 21, 23, 24 apply the power control signals PS1, PS3, PS4 (at low level) to the operational amplifiers 11, 13, 14 and recognize that the operational amplifiers 11, 13, 14 are to be deactivated.

At a beginning timing t7 of an ON period ONT2 of the second horizontal synchronization period HSP2 following the first horizontal synchronization period HSP1, the logic circuit 22 activates the operational amplifier 12 using the power control signal PS2 (at high level), while the logic circuits 21, 23, 24 deactivate the operational amplifiers 11, 13, 14 using the power control signals PS1, PS3, PS4 (at low level). Also at this timing t7, the control circuit 90 turns on the switches SWA, SWB, SWC using the open/close control signal CP (at high level), that is, making a connection between the vertical lines LA, LB, LC and the output terminals PA, PB, PC. As a result, the voltage Vq from the operational amplifier 12 is output by the output terminal PA via the horizontal line M2, the switch 52A, and the vertical line LA.

As mentioned above, the driver 1 of the present exemplary embodiment includes the control circuit 90, the decoder 70A, and the logic circuits 21 to 24 cooperating to recognize that, during the OFF period OFT1 of the first horizontal synchronization period HSP1 based on the image data D5 to D0 (A_A1) to be displayed during the second horizontal synchronization period HSP2, only the operational amplifier 12 is to be activated and the other operational amplifiers 11, 13, 14 are to be deactivated during the ON period ONT2 of the second horizontal synchronization period HSP2. Thus, the operational amplifier 12 is activated, while the other operational amplifiers 11, 13, 14 are deactivated at the beginning timing t7 of the ON period ONT2. This makes it possible to reduce the amount of power consumed compared to related art drivers that always activate all the operational amplifiers 11 to 14.

In addition to the above-mentioned activation of the operational amplifier 12 by the decoder 70A during the OFF period OFT1 of the first horizontal synchronization period HSP1, the decoder 70B, which synchronizes with the decoder 70A, and the logic circuits 21 to 24 cooperate to recognize that, during the OFF period OFT1 of the first horizontal synchronization period HSP1 based on the image data D5 to D0 (B_A1) to be displayed during the second horizontal synchronization period HSP2, only the operational amplifier 11, for example, is to be activated during the ON period ONT2 of the second horizontal synchronization period HSP2. Furthermore, the decoder 70C, which synchronizes with the decoders 70A, 70B, and the logic circuits 21 to 24 cooperate to recognize that, during the OFF period OFT1 of the first horizontal synchronization period HSP1 based on the image data D5 to D0 (C_A1) to be displayed during the second horizontal synchronization period HSP2, only the operational amplifier 12, for example, is to be activated during the ON period ONT2 of the second horizontal synchronization period HSP2. In this case, the logic circuits 21 to 24 activate only the operational amplifiers 11, 12 at the beginning timing t7 of the ON period ONT2 of the second horizontal synchronization period HSP2. To put it another way, during the OFF period OFT1 of the first horizontal synchronization period HSP1, the driver 1 identifies which of the operational amplifiers 11 to 14 is to be required during the ON period ONT2 of the second horizontal synchronization period HSP2 based on the plurality of image data D5 to D0 (A_A1), (B_A1), (C_A1) to be displayed during the second horizontal synchronization period HSP2, and activates only the required one at the timing t7. This makes it possible to reduce the amount of power consumed compared to related art drivers that always activate all the operational amplifiers 11 to 14

First Exemplary Modification

Figure 6:
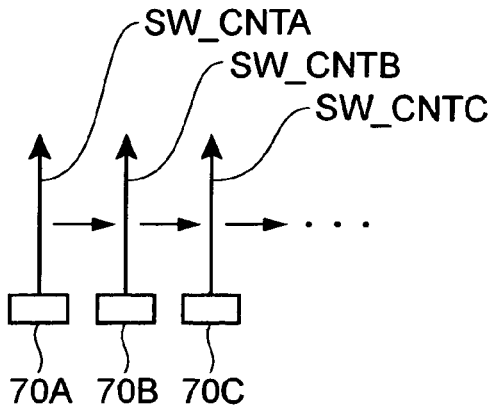
FIG. 6 is a schematic that shows the operation of a first exemplary modification.

Instead of the above-mentioned operational structure, in which in sync with the timing the decoder 70A outputs the switching control signal SW_CNTA corresponding to the image data D5 to D0 (A_A1) to the switches 51A to 54A, the other decoders 70B, 70C output the switching control signals SW_CNTB, SW_CNTC corresponding to the image data D5 to D0 (B_A1), (C_A1) to the switches 51B to 54B, 51C to 54C, respectively, the following operational structure is also conceivable. During the OFF period OFT1 of the first horizontal synchronization period HSP1 as shown in FIG. 6, the decoders 70A, 70B, 70C may sequentially output the switching control signals SW_CNTA, SW_CNTB, SW_CNTC to the switches 51A to 54A, 51B to 54B, 51C to 54C, respectively. More specifically, during the OFF period OFT1, a cycle of operations from the timing t1 to the timing t7 shown in FIG. 5 is executed sequentially for the vertical lines LA, LB, LC in this order. Like the above-mentioned exemplary embodiment, this makes it possible to identify which of the operational amplifiers 11 to 14 is required to be activated, and moreover, to what degree each required operational amplifier is to be activated.

For example, the decoder 70A outputs the switching control signal SW_CNTA corresponding to the image data D5 to D0 (A_A1), making the logic circuit 21 recognize that the operational amplifier 11 is to be activated for one vertical line. Then the decoder 70B outputs the switching control signal SW_CNTB corresponding to the image data D5 to D0 (B_A1), making the logic circuit 22 recognize that the operational amplifier 12 is to be activated for one vertical line. Subsequently, the decoder 70C outputs the switching control signal SW_CNTC corresponding to the image data D5 to D0 (C_A1), making the logic circuit 22 recognize that the operational amplifier 12 is to be activated for another vertical line, which means that the operational amplifier 12 is to be activated for two vertical lines in total. Therefore, the logic circuits 21 to 24 recognize that for how many vertical lines each required operational amplifier is to be activated. This makes it possible to control the degree of activation using the power control signals PS1 to PS4, and thereby increasing accuracy in the activation and decreasing the amount of power consumed compared to the above-mentioned exemplary embodiment.

Second Exemplary Modification

Figure 7:
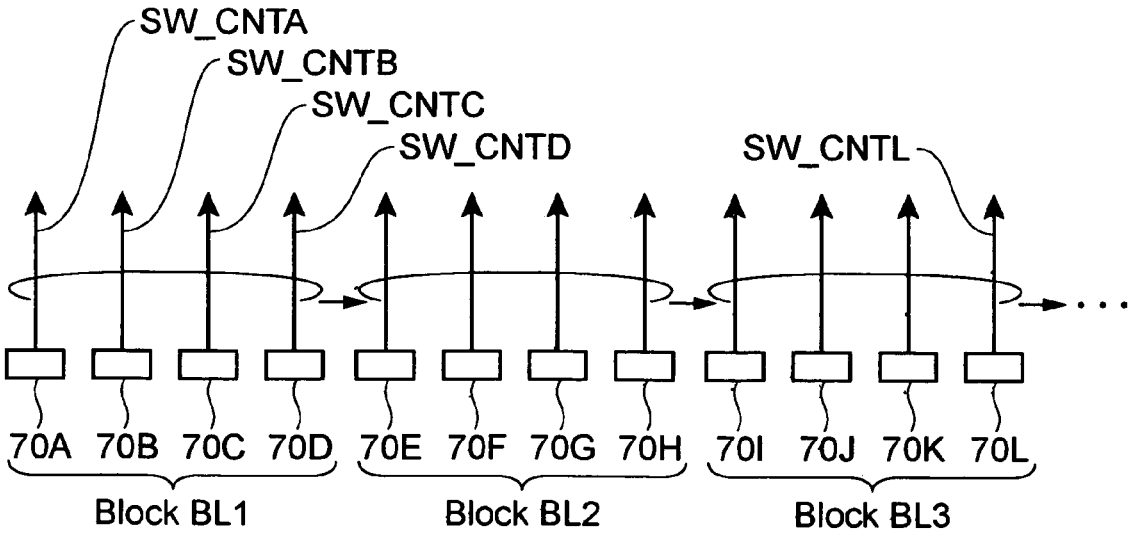
FIG. 7 is a schematic that shows the operation of a second exemplary modification.

Instead of the operational structure of the first exemplary modification, another operational structure is also conceivable in which the decoders 70A, 70B, 70C, i.e. the switching control signals SW_CNTA, SW_CNTB, SW_CNTC, are divided into a plurality of blocks BL1, BL2, BL3 (not limited to the three) as shown in FIG. 7. For example, the block BL1 is composed of the decoders 70A, 70B, 70C, 70D.

In addition, during the OFF period OFT1, a cycle of operations from the timing t1 to the timing t7 shown in FIG. 5 is executed sequentially for the blocks BL1, BL2, BL3 in this order. Moreover, the switching control signal SW_CNT from the decoder 70, more specifically, the switching control signals SW_CNTA, SW_CNTB, SW_CNTC, SW_CNTD from the decoder 70A are output all at once. These allow a reduction in power consumed compared to the above-mentioned exemplary embodiment.

For example, during the OFF period OFT1 of the first horizontal synchronization period HSP1, the decoders 70A to 70D output the switching control signals SW_CNTA to SW_CNTD all at once, making the logic circuits 21 to 24 recognize that the operational amplifiers 11, 12 are to be activated. Then, decoders 70E to 70H output switching control signals SW_CNTE to SW_CNTH all at once, making the logic circuits 21 to 24 recognize that the operational amplifiers 11, 13 are to be activated. Subsequently, decoders 70I to 70L output switching control signals SW_CNTI to SW_CNTL, making the logic circuits 21 to 24 recognize that the operational amplifiers 11, 12 are to be activated. In this case, the operational amplifier 11 needs to take the three blocks BL1, BL2, BL3, and is required to be activated for 12 vertical lines at most (four lines×three blocks); the operational amplifier 12 needs to take the two blocks BL1, BL3, and is required to be activated for eight vertical lines at most (four lines×two blocks); the operational amplifier 13 needs to take the one block BL2, and is required to be activated for four vertical lines at most (four lines×one block); and the operational amplifier 14 is not required to be activated at all.

Therefore, the logic circuit 21 activates the operational amplifier 11 for 12 vertical lines using the power control signal PS1, the logic circuit 22 activates the operational amplifier 12 for eight vertical lines using the power control signal PS2, the logic circuit 23 activates the operational amplifier 13 for four vertical lines using the power control signals PS3, and the logic circuit 24 deactivates the operational amplifier 14 using the power control signal PS4. The total amount of power consumed in the second modification is for 24 vertical lines (12+8+4+0), which is less than that of related art drivers that always activate the operational amplifiers 11 to 14 each for 12 vertical lines, that is, consuming power for 48 vertical lines (12 lines×four operational amplifiers).

What is claimed is:

1. A driver comprising:

a plurality of operational amplifiers;

a plurality of first lines;

a plurality of second lines intersecting the plurality of first lines;

a plurality of switches, each of the plurality of switches controls an electrical connection between one first line of the plurality of first lines and one second line of the plurality of second lines; and a plurality of logic circuits, the plurality of first lines being set to a first voltage during a first period, the plurality of second lines being set to a second voltage during a second period, one switch of the plurality of switches being controlled based on one data signal of data signals, upon the one switch being turned on during the second period, the one first line being electrically connected to the one second line so as to setting the one first line to the second voltage, one logic circuit of the plurality of logic circuits detecting a voltage level of the one first line during the second period, the one logic circuit being connected with the one first line during the second period, and being disconnected with the one first line during any other than the second period, upon the one logic circuit detecting the second voltage during the second period, the one logic circuit outputting the control signal to activate one operational amplifier during a third period, the one operational amplifier outputs a third voltage corresponding to the one data signal, and the one second line being set to the third voltage during the third period, the third voltage being outputted to the one first line from the one operational amplifier, the third voltage electrically transmitting through the one first line and the one switch.

2. The driver according to claim 1, the one operational amplifier being deactivated during any other than the third period.

3. The driver according to claim 1, upon the one logic circuit detecting the first voltage during the second period, the one logic circuit outputting the control signal to deactivate the one operational amplifier during the third period.

4. The driver according to claim 1, the plurality of second lines supplying a plurality of grayscale level signals to a display, the plurality of grayscale level signals corresponding to the data signal.

5. A method that drives a circuit, comprising:

setting a plurality of first lines to a first voltage during a first period, setting a plurality of second lines to a second voltage during a second period, controlling one switch of a plurality of switches based on one data signal of the data signals, each of the one switch controls electrical connection between one first line of the plurality of first lines and one second line of the plurality of second lines, upon the one switch being controlled to turn on, the one switch setting the one first line to the second voltage during the second period, detecting a voltage level of the one first line with one logic circuit of a plurality of logic circuits during the second period, wherein in the detecting of the voltage level, the one logic circuit being electrically connected with the one first line during the second period, and being disconnected with the one first lines during other than the second period, activating one operational amplifier of a plurality of operational amplifiers during a third period upon the one logic circuit detecting the second voltage during the second period, outputting a third voltage corresponding to the one data signal to the one first line from the one operational amplifier, and setting the third voltage to the one second line during the third period, the third voltage electrically transmitting through the one first line and the one switch.

6. The driving method according to claim 5, wherein in the outputting of the third voltage, the one operational amplifier being deactivated during any other than the third period.

7. The driving method according to claim 5, wherein in the detecting and outputting of the third voltage, upon the one logic circuit detecting the first voltage during the second period, the one logic circuit outputting the control signal to deactivate the one operational amplifier during the third period.

8. The plurality of second lines according the claim 5 supplying a plurality of grayscale level signals to a display, the plurality of grayscale level signals corresponding to the data signal.

* * * * *